United States Patent [19]

Kuchler

[11] Patent Number: 4,586,409

[45] Date of Patent: May 6, 1986

[54] SLICING MACHINE FOR COLD CUTS

[75] Inventor: Fritz Kuchler, Klagenfurt, Austria

[73] Assignee: Brain Dust Patents Establishment, Vaduz, Liechtenstein

[21] Appl. No.: 595,949

[22] Filed: Apr. 2, 1984

[30] Foreign Application Priority Data

Apr. 1, 1983 [AT] Austria ..... 1173/83

[51] Int. Cl.[4] ..... B26D 7/32

[52] U.S. Cl. ..... 83/112; 83/96; 83/155

[58] Field of Search ..... 83/168, 95, 92, 154–155, 83/94, 91, 96, 112, 161

[56] References Cited

U.S. PATENT DOCUMENTS

| | | | |
|---|---|---|---|
| 2,024,404 | 12/1935 | Van Berkel | 83/96 |
| 2,309,554 | 1/1943 | Van Berkel | 83/92 |
| 3,739,677 | 6/1973 | Müller et al. | 83/94 |
| 3,958,475 | 5/1976 | Zapomel | 83/95 |

*Primary Examiner*—Donald R. Schran

*Attorney, Agent, or Firm*—Karl F. Ross; Herbert Dubno

[57] ABSTRACT

A slicing machine with a carriage for the goods to be sliced, a blade against which the goods are drawn to form a slice, a mechanism for carrying away the slices and a blade-cleaning member which is disposed along the rear of the blade and serves to deflect the slicing away from the latter toward the slide conveyor. Between the slice conveyor and the latter member, a plurality of gripper bands are provided to transfer the slices to the conveyor, the gripper band passing around rollers in recesses of the blade cleaning member.

10 Claims, 3 Drawing Figures

SLICING MACHINE FOR COLD CUTS

FIELD OF THE INVENTION

My present invention relates to a cold cut slicing machine with a carriage for receiving the uncut body of sausage, cheese or the like to be sliced, a rotating blade with a guide for adjusting cutting or slice thickness, a device for delivering the cut slices from the blade to a conveyor which preferably consists of horizontal parallel, aligned and activated conveyor bands or chains with points, which transport each slice to a depositing station, and a kicker which reaches behind the conveyor bands or chains and pulls away each slice from the points on which they are pierced and throws them on a depositing table.

BACKGROUND OF THE INVENTION

With cold cut slicing machines one always had to take care that the cutting thickness was not set too thin, since then the cut slice would fold itself during the transport between knife and conveyor device and/or and the slice would be torn in transport. There are kinds of meat, especially smoked meat or Bündnerfleisch which must be sliced very thinly. Especially with these kinds of foodstuff repeated breakdowns of the machine occurred.

OBJECT OF THE INVENTION

The object of the invention is to avoid the disadvantages of the prior art and to provide a machine which is capable of exactly depositing very thin slices.

SUMMARY OF THE INVENTION

This is attained in accordance with the invention by providing the delivery device with a cleaner very near to the cutting edge of the blade reaching out for receiving the slices during the cutting operation, whose guiding surface includes an acute angle toward the blade and which has lateral axes and/or guide pullies for gripper bands which lead from the cleaner away to a guide roller of the conveyor bands or chains. A guide sheet or a roller is provided opposite the gripper bands. The cleaner reaches into the groove of the blade, where the slice is received, caught by the gripper bands and transported into the direction of the conveyor bands. A guide sheet or one or more rollers are positioned opposite the gripper bands and prevent the turning aside of the slices in the transfer area between blade and conveyor device.

It is useful if the cleaner is swingable on a parallel towards the cutting surface arranged axis and a setting device is provided, especially one in the form of a setting screw, which is positioned next to the cleaner in opposite draw of the gripper bands, With the setting screw an accurate setting of the cleaner can be obtained, which as close as possible is driven toward the blade, without, however, touching it.

The setting movement in the range of millimeters and requires simultaneously an adjustment of the tension of the gripper bands. In a special application of the invention the gripper bands are guided between the conveyor bands or chains around the guide roller and have on their running surface a continuous keel like rib for exact guidance, The peripheral speed of the gripper bands is then the same as the peripheral speed of the conveyor bands or chains.

When the rollers of the gripper bands run freely opposite. the rollers of the conveyor bands, the peripheral speed of the gripper bands is then determined directly by the advance of the cut slices.

The guide sheet arranged opposite of the gripper bands is suitably formed as a two-armed lever whose rotation axis sits in guides, which are rotatably deposited on the frame of the conveyor device. The end of the one lever arm of the guide sheet is arranged close to the impact plate and the end of the other lever arm carries rollers for pressing the cut slices on the points of the conveyor bands or chains, where the distance between the rollers and conveyor bands is the same as the space between blade and impact plate which determines the cutting thickness. The guide sheet can therefore on the one hand without problem and without special preparatory actions be swung away from its use position. In the use position the guide sheet is rotated around its axis at each cutting size setting, so that upon decreasing of the cutting size the rollers are brought closer to the conveyor bands or chains. The delivery of the goods to be cut therefore takes place by taking the diameter into consideration. It is especially advantageous when the rollers have a larger diameter at the edge than in the center area and when the rollers in the running surface of the points, are arranged on the bands or chains and overlap the same. With this each slice is especially effectively pressed onto the points. Further it is useful when the guide sheet is arranged comblike in towards each other parallel facing flaps or fingers and/or has prongs for decreasing the contact surface with the cut slices.

In another guiding device of the invention in which a roller is opposite the delivery device, the roller has toothed rims, which in some cases are provided with points and preferably the roller lies against the gripper bands and/or against the conveyor band or chains. When the rotating axis of the roller is arranged on guides, which on the one hand are hinged on the frame of the conveyor device and on the other hand are braced on the impact plate, then the roller will set itself. In order to assure a uniform delivery of the slices from the knife to the conveyor device, the roller can be operable with the speed of the cutting carriage for the goods or the conveyor bands or chains. The slices can then neither be torn nor pushed together.

SPECIFIC DESCRIPTION

Figure 1:
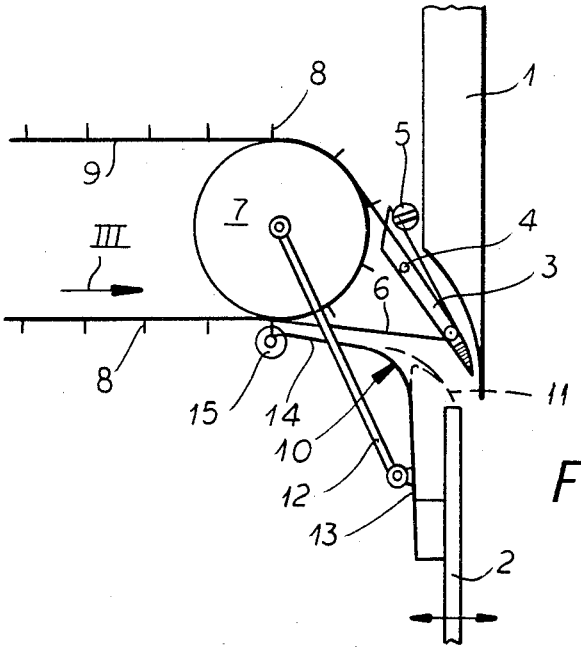
FIG. 1 is a diagrammatic side elevation of a delivery device.

A rotating blade 1 has an adjustable impact plate 2 for the cut goods disposed in front of it and moveable as shown by the double-headed arrow. Along the impact plate 2 the cut goods (sausage, cheese and the like) are delivered to the blade 1. The thickness of the cut slice depends upon the position of the impact plate 2 relative to the plane of the cutting edge of the blade.

A cleaner 3 is provided behind the blade 1, which reaches into a groove formed behind the cutting edge of the blade 1. The cleaner 3 is rotatable about a horizontal axis 4. The space between the blade 1 in the cutting area and the cleaner 3 can be adjusted by turning a conically tapered setting screw 5.

Figure 3:
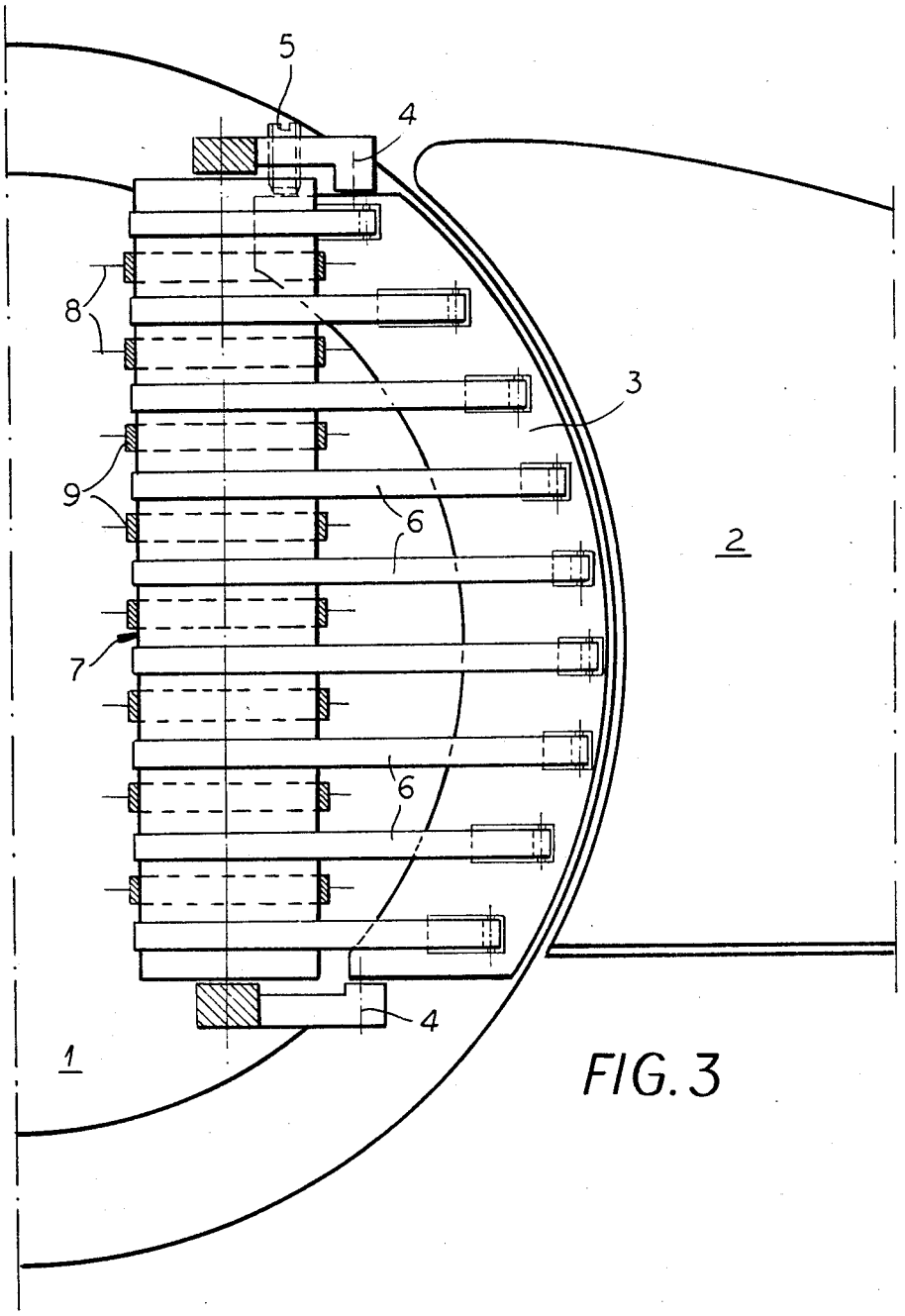
FIG. 3 is a side view of a part of the delivery device.

The cleaner 3, which is formed as shown in FIG. 3 as a bent guiding element adjusting itself to the groove of the blade 1, has recesses with guide rollers, around which gripper bands 6 are arranged. These gripper bands 6 furthermore are run over a guide roller 7, which is part of a conveyor device which is formed as a chain frame.

A slice of sausage which has been cut by the blade 1 during the cutting operation is deflected by the cleaner 3 and passed on to the gripper bands 6, which advances the slice until the slice is seized by the points 8 of the conveyor bands 9 or chains and engaged for further transportation.

The gripper bands 6 are operated in the example according to FIG. 1 by the guide roller 7. The peripheral speed of the gripper bands 6 corresponds to the advancing speed of a carriage for cut goods, which is not illustrated, so that it is assured that the slice will be removed with that advancing speed from the cutting location as the cutting goods had been delivered to the blade 1. An alternative thereto is that the guide roller can consist of parallel layered rollers, of which those, which displace the gripper bands 6 are running free. It is also possible, to provide between the operating rollers of the conveyor bands 9 and the rollers of the gripper bands 6 one or more slip couplings to prevent tearing the slices and to assure a gentle, uniform transfer from blade 1 to the conveyor device.

The gripper bands 6 as well as the cleaner 3 are disposed opposite (FIG. 1) a guide sheet 10. An insert sheet 11 with springs can preferably be arranged on the lower part of the guide sheet. The guide sheet 10 is pivotable on two guides 12 and forms a two-armed lever. The one lever arm 13 is connected with the impact plate 2 and takes part in the cut size setting. The second lever arm 14 carries rollers 15 on its end, which press against the conveyor bands 9 and especially against the points to ensure that a slice is pushed and secured on the points. This pressing device can be removed from the operating position by means of the guides. This is very advantageous for cleaning purposes.

Figure 2:
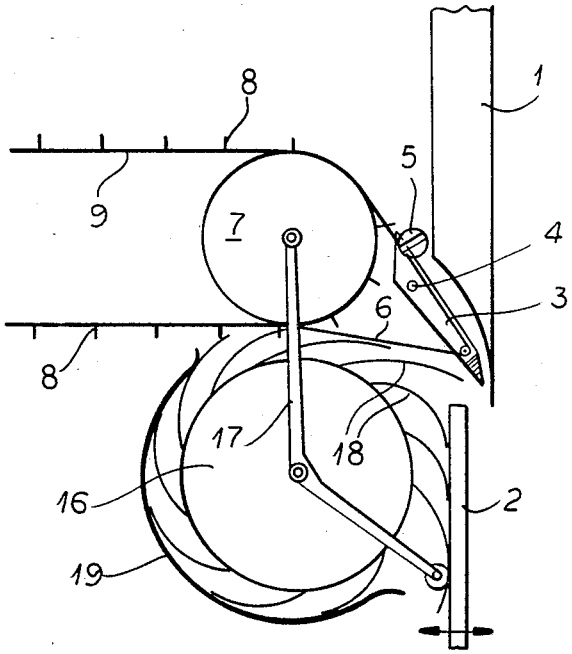
FIG. 2 is a similar view of an alternative embodiment.

Another auxiliary system shows in FIG. 2. A roller 16 is arranged oppositely of the gripper bands 6 as well as the conveyor bands 9. It is rotatable on guides 17 and is depositioned by re-setting of the impact plate 2 (resetting of cutting size) relatively towards the conveyor bands 9 and the gripper bands 9. Large cutting sizes need, as also shown in FIG. 1, a wider space between roller 16 and the delivery device. Roller 16 can be provided with protrusions, especially teeth or points, which act upon the slices and together with the gripper bands and without interruption continue to tranpsort them. Obliquely arranged flaps or fingers 18 extend from roller 16 and consist of elastic material, which touch the slices and press them against the gripper bands 9. The finger 18 cover the upper surface of the roller 16, that is they are provided in parallel rims at the same level as the gripper bands 6 on the roller 16. In the area of the gripper bands 6 which is turned away from the roller 16 a cover 19 is provided behind which fingers 18 are pulled in during rotation of the roller. Instead of fingers 18 bristles can also be used.

Roller 16 can be freely running or operated in such a way that its peripheral speed is equal to the advancing speed of the carriage for the cut-goods or the conveyor device (conveyor bands 9). The fingers 18 can be further realized by bent sheet metal strips, which are arranged on the roller 16 in a rotatable fashion and by means of a spring each, are clamped in front in radial direction.

FIG. 3 shows a view of the cleaner 3 with the gripper bands 6 and the guide roller 7 with the auxiliary roller system removed (guide sheet 10, FIG. 1 or roller 16, FIG. 2). The gripper bands 6 have the purpose to turn away the cleaner 3 from around the axis 4 out of the drawing plane or from the blade 1. The setting screw 5 on which tapered sleeve cleaner 3 is arranged, forms an impact and presses the cleaner 3 during screwing in place in direction of the blade 1.

In the method according to FIG. 3, the guide rollers of the gripper bands 6, which are arranged next to the blade, lie on a circular arc. Tests have shown that an arrangement of gripper bands of equal length, whose guide rollers in the cleaner lie on a joint axis, bring advantages, not only constructive ones, but also concerning the sure grip of cut slices. The gripper bands 6 can have for their secure guidance on the running surface a V-shaped rib in the form of a continuous leading keel and the guide rollers or -axes correspondingly formed grooves. Also a ball-shaped or concave running roller or axle upper surface is useful for centering the gripper bands.

I claim:

1. In a slicing machine which comprises a rotatable blade, a carriage for goods to be sliced displaceable relative to said blade whereby a slice is formed at a slicing speed along a rear side of said blade, a blade cleaner disposed along said rear side of said blade for deflecting said slice away from said blade, said blade cleaner having guiding surfaces at an acute angle with said blade and a slice conveyor spaced from said rear side of said blade for collecting said slice therefrom, the improvement which comprises:

a plurality of gripper bands in mutually parallel spaced-apart relationship, and said blade cleaner being formed with a multiplicity of spaced apart guide members, said gripper bands passing respectively around which said guide members;

a guide roller at one end of to said conveyor, said bands passing around said guide roller for carrying slices onto said conveyor; and means juxtaposed with said gripper bands for applying said slices thereagainst.

2. The improvement defined in claim 1, further comprising means for mounting said blade cleaner so as to enable it to swing about an axis substantially parallel to a cutting plane defined by said edge and a setting device acting upon said blade cleaner to displace the same about said axis and effective against traction applied by said gripper bands to said members.

3. The improvement defined in claim 1 wherein said guide roller is a guide roller for said conveyor and endless elements of said conveyor pass around said guide roller in interdigitated relationship with said gripper bands.

4. The improvement defined in claim 1 wherein said means juxtaposed with said gripper bands includes a guide sheet formed as a two-arm lever and pivoted on an axis formed by supports shiftable with an impact plate against which said goods can be pressed, said impact plate being adjustable relative to said blade to establish slice thickness, thereby adjusting the position of said guide sheet, one arm of said guide sheet lying against said impact plate, another arm of said guide sheet being formed with rollers for pressing cut slices onto said conveyor.

5. The improvement defined in claim 4 wherein said rollers on said other arm of said guide sheet have larger diameters at the edge than in center areas and said conveyor comprises endless elements formed with points against which said rollers on said guide sheet impel said slices.

6. The improvement defined in claim 4 wherein said guide sheet is formed with fingers acting upon said slices and limiting contact area therewith.

7. The improvement defined in claim 1 wherein said means juxtaposed with said gripper bands includes a roller deflecting said slices against said gripper bands and operatively coupled within an impact plate for said goods which is displaceable relative to said blade to adjust slice thickness.

8. The improvement defined in claim 7 wherein the roller forming said means juxtaposed with said gripper bands is mounted on supports which are pivotal relative to a machine frame and brace against said impact plate.

9. The improvement defined in claim 7 wherein said roller forming said means juxtaposed with said gripper bands is provided with elastic fingers protruding therefrom.

10. The improvement defined in claim 9, further comprising a narrower sheet positioned to deflect said fingers inwardly to enable them to spring out as they approach said blade cleaner.

* * * * *